United States Patent [19]

Groeschel

[11] 4,198,889

[45] Apr. 22, 1980

[54] MODULATION CIRCUITRY FOR USE IN A MUSIC ENCODING SYSTEM

[76] Inventor: Charles R. Groeschel, 2402 Ansbury, Houston, Tex. 77018

[21] Appl. No.: 757,751

[22] Filed: Jan. 7, 1977

[51] Int. Cl.[2] ..... G10H 1/00

[52] U.S. Cl. ..... 84/1.01; 340/206; 340/353

[58] Field of Search ..... 84/470, 115, 1.01, 1.03; 340/365 R, 365.5, 203, 205, 206, 347 DD, 349

[56] References Cited

U.S. PATENT DOCUMENTS

| | | | |
|---|---|---|---|
| 3,462,736 | 8/1969 | Hollands | 340/203 |
| 3,610,799 | 10/1971 | Watson | 84/1.01 |

*Primary Examiner*—Michael L. Gellner
*Assistant Examiner*—S. D. Schneyer
*Attorney, Agent, or Firm*—Donald Gunn

[57] ABSTRACT

An apparatus for encoding data representative of keyboard music is disclosed. In the preferred embodiment, the data source is a keyboard which is played by a musician which incorporates a set of switches forming key closures. The closures themselves represent the music. The music is encoded by grouping the keyboard in convenient sized groups, typically octaves, and all of these groups are input to a buffer. A multiplexer scans the buffer. Timed generators form the synchronization wave-forms, space wave-forms and mark wave-forms. All of these wave-forms are generated in timed sequence. They are input to a flip flop which forms an output word on a two wire carrier system. The two wire output encodes all data required for word decode; namely, clock, sync, mark, and space data.

7 Claims, 2 Drawing Figures

FIG. 1
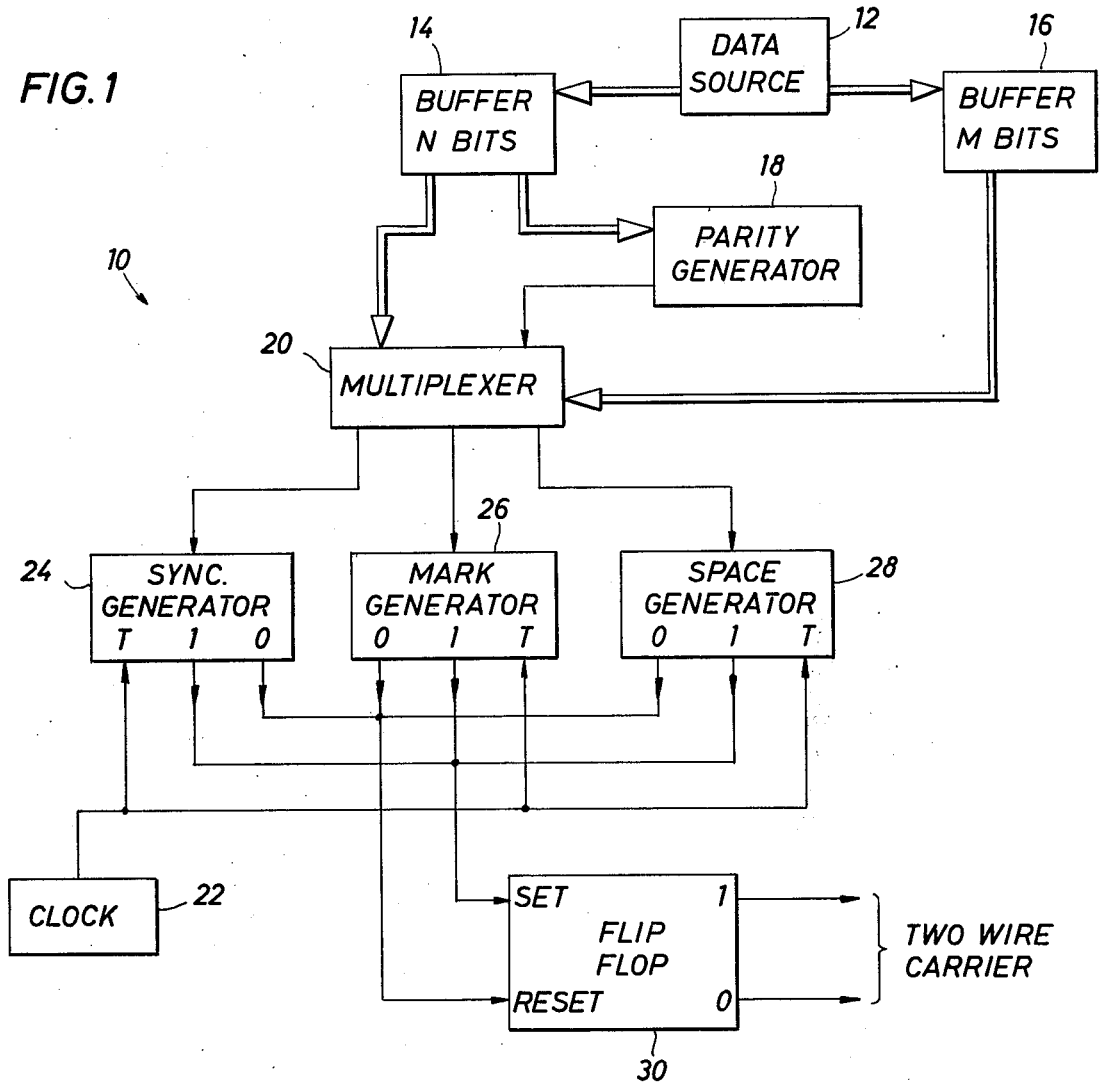
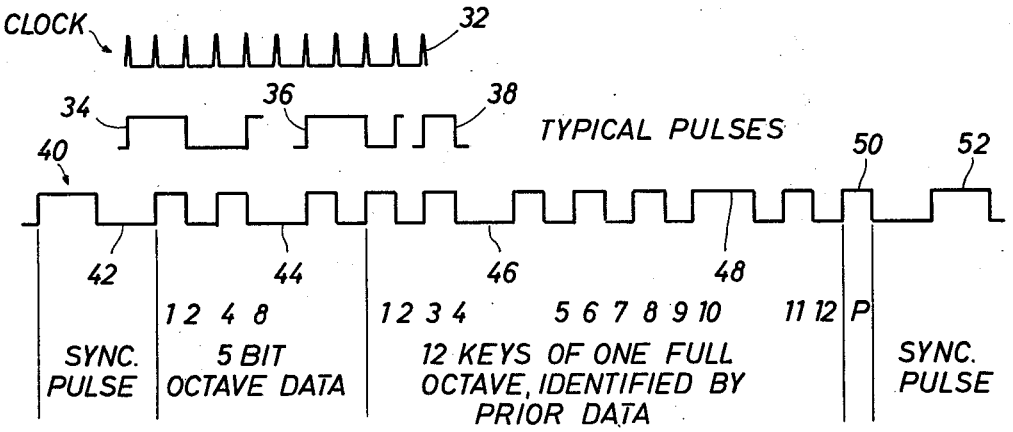
FIG. 2

MODULATION CIRCUITRY FOR USE IN A MUSIC ENCODING SYSTEM

BACKGROUND OF THE DISCLOSURE

As described in applicant's co-pending patent application Ser. No. 485,983 which was filed July 5, 1974, now U.S. Pat. No. 4,023,456 a system for encoding music is disclosed. The apparatus which is shown in that application is used in encoding and decoding a keyboard instrument. It forms electrical signals readily recorded for subsequent playback. The apparatus is believed to be quite successful as disclosed.

That disclosure pre-supposes some type of tape recording apparatus or a two wire transmission system. The term "two wire" refers to a transmission system where the band width of the data which is being transferred by the system can be readily placed on a pair of wires and, indeed, they need not be coaxial wires to enable transmission of an extremely wide band width. The band width which is required for the transmission of the musical data modulated in this form is within the audio range of typical commercial grade telephone circuitry, typically a pass band of 0.3 to 3.0 kilohertz.

The present invention is therefore an accessory to that equipment. It enables the data to be transferred over unlimited distances using a two wire carrier system of any desired construction. The apparatus forms a digital signal where the freguency content is less than about three thousand hertz to enable the transmission of keyboard music. The present invention is a unique modulation device. It is particularly unique in that it forms a procession of pulses which can be transferred on open wires without regard to carrier frequency insertion, clock signal, synchronization pulses, and so on. It can be easily recorded on a single channel tape recording apparatus. Substantial loss of quality can be endured without destroying the wave form of the signal to be stored or transferred.

BRIEF DESCRIPTION OF THE ILLUSTRATED EMBODIMENT

This embodiment is a modulation apparatus for converting the depressions of certain keys in keyboard musical instruments into signals and forming them into a digital word to be transmitted on a two wire carrier system. A multiplexer interrogates a buffer of a designated number of bits in length. If desired, and the preferred embodiment so illustrates, a parity generator is incorporated. A second buffer of a different length is likewise interrogated. A multiplexer scans the various data sources in a desired sequence. The multiplexer then forms signals controlling the timed operation of a synchronization signal generator, a mark generator and a space generator. All three generators are operated by a clock which times their operation. The three generators form outputs supplied to a flip flop and a signal is formed by it to be impressed on a two wire carrier system.

BRIEF DESCRIPTION OF THE DRAWINGS

FIG. 1 is a schematic block diagram of the apparatus of the present invention; and FIG. 2 is a timing chart showing the various signals formed by the present invention.

DETAILED DESCRIPTION OF THE PREFERRED EMBODIMENT

Attention is first directed to FIG. 1 of the drawings where the present invention is identified generally by the numeral 10. It will be described in conjunction with certain cooperative circuitry. The cooperative circuitry best adapted to the present invention is the music encoding and decoding equipment there shown in co-pending disclosure application Ser. No. 485,983, now U.S. Pat. No. 4,023,456, which was previously referenced. That serves as a data source. Briefly, the data source 12 has the form of a multi-bit word which is formed into digital data. In the intended application, the referenced equipment divides a keyboard instrument into a multitude of octaves. Dependent on size, it includes several octaves of keys. As the keys are played, signals are formed indicating closure of the various keys. This then results in the formation of twelve bits (one octave) which are input to a first buffer 14. It preferably has a length of 12 bits. The 12 bits correspond to the length of the octave, namely, 12 keys. The 12 keys, of course, represent 12 notes in the octave. The number 16 identifies a second buffer which has a different length and which receives a multi-bit word representative of a particular octave. As the keyboard is scanned, various keys are opened or closed and a unique encoded designation for that particular octave is formed. Thus, each time a key is played resulting in opening or closure of a switch for that key, a signal is formed to identifly the particular octave and for the particular key thereof. This results in data being placed in the buffer 14 and also in the buffer 16. Each word is a "stand alone" message including the precise data necessary for reproduction. If a word is lost or jumbled out of order with other words, no harm occurs. The buffer 14 is connected to a parity generator 18 which forms an output indicative of even or odd parity as desired. If there is a tendency to offset the average DC value as might occur when there are significantly more ones rather than zeroes in the data, the parity generator preferably forms a parity bit which is of the opposite polarity to adjust the average value of the data, this being a secondary purpose thereof. The primary purpose of the parity generator is, of course, to form a parity bit for proving the quality of the transmitted data.

The present invention utilizes a multiplexer 20 which has multiple inputs, namely, the buffer 14, the buffer 16, and the generator 18. It scans the three sources of information. They are scanned in a specified sequence. When the multiplexer 20 reaches the end of its scan operation, it recycles to the beginning to form the next word. In the operation of the present invention, one word is formed by one cycle of operation of the muliplexer which encodes data from the three digital data sources connected to it. The numeral 22 identifies a clock. It forms periodic pulses of a fixed repetition rate. The clock 22 is input to three signal generators. They are all used to form the output data. One of the three is the synchronization generator 24. It forms a pulse which will be labeled the "sync" pulse hereinafter. A second generator is the mark generator. It is identified by the numeral 26. The third generator is the space generator, identified by the numeral 28. All three generators are similar in construction. They are timed in operation by the clock 22. It is a trigger input for each. Each one preferably forms an output wave form on two wires, one conveniently labeled the zero output and the other being the one output. The several outputs of the generators 24, 26 and 28 are connected on common conductors to the set and reset inputs of a flip flop 30. The flip flop 30 has zero and one outputs which are in turn connected to a two wire carrier system for transmission.

For a better understanding of the present invention, FIG. 2 shows a timing chart. In FIG. 2, the numeral 32 identifies the procession of pulses output by the clock 22. The amplitude is not critical; the timing of the pulses is rather important because it is the source of timing for operation of the entire system. Decoding can be accomplished using either synchronous or asynchronous method. The method selected is determined by the type of transmission system used. In addition, the timing chart shows typical pulse wave forms. The numeral 34 identifies a sync pulse. It will be observed to be four time units long. The numeral 36 identifies a mark pulse which is three units long, a longer pulse followed by a shorter pulse. By contrast, a space pulse is only one time unit long and is identified by the numeral 38.

With regard to the pulses 34, 36 and 38 which are exemplified in FIG. 2, they may be inverted from the illustrated form. They are shown with a positive going initial slope. Indeed, they can begin with a negative going signal. The data which is encoded in them is found in the wave shape, not the polarity. The change of polarity thus is only part of the wave shape. Phasing of the transmission line is not required. It is not mandatory that they be positive going. This will be exemplified in discussion of a typical data word obtained from the use of the present invention for encoding musical data.

FIG. 2 shows at 40 one word. The one word is strictly an example of musical data encoded through the use of the present invention. So that the word 40 will be understood, the conditions which were encoded will be described. The location of the data bits in the word 40 will then be set forth. As an example, it will be presumed that five bits are necessary to describe the octave number. This may be more than necessary; nevertheless, five bits are included in the exemplary wave form 40. In this particular instance, the data of interest is found in the eighth octave. The signal of course, is not limited to the eighth octave and indeed, the data can be in any octave bearing any designation. It is noted that the device is capable of encoding 32 octaves when utilizing five bits. This presumes that a parity bit is not formed as part of the octave indication. If desired, a parity bit can be included with the bits descriptive of the particular octave designation. In addition, the beginning condition is that the fourth and tenth notes in that particular octave have been struck. Again, the particular notes struck and the number of notes struck can be varied. This is solely for purposes of providing an example of the operation.

Considering the data word 40 from the beginning, the first wave form incorporated is a sync pulse 42. This is used to indicate the beginning of a data word. It will be observed that it is four time units in length. Next, the word 40 incorporates five bits descriptive of the octave designation. Given the requirement that five bits are necessary, the octave number is encoded and in the illustrated example, a mark 44 is placed at the eight bit position. Thus, the five bit octave designation code is 00010. The least significant bit is at the left hand end. Again, some other arrangement can be used such as positioning the least significant bit at the right hand end. Of particular importance to the present invention is the fact that a mark (three time units long) is incorporated among several spaces which are only one time unit in length. It will be observed that the mark begins with a negative going signal. The negative going signal occurs because the immediately preceding signal is a positive going signal. Thus, the preceding pulse, being positive, is distinguished from the mark by the change in polarity. Needless to say, the mark 44 could be equally easily recognized if its polarity was opposite.

The remainder of the word 40 includes twelve bits of data for the particular octave. The fourth key of the octave is closed as indicated by the mark at 46. The mark at 48 is indicative of closure of the tenth key. It will be observed that the marks 46 and 48 are both three time units in length. As circumstances dictate, they are of opposite polarity. This again is perfectly acceptable in the operation of the present invention.

The numeral 50 indicates a space formed at the parity position. The parity bit follows the twelve bit code which represents the full octave of data. The next word is identified by the beginning sync pulse at 52. Needless to say, the word can be similar or different in data content, but it is organized in the same fashion. If desired, it is possible to place the octave designation data after the encoding of the twelve keys.

On viewing the data word 40, it will be noticed that it is made up mostly of spaces. For instance, of the twelve notes found in the octave, only two are shown to be struck, the remaining ten being unstruck. The remaining ten are therefore represented by a space. Since the space is the most common event to be encoded, it is represented by the shortest pulse form, having a length of only one time unit. The space that precedes each of the marks 44, 46 and 48 determines the initial polarity of the mark. There is no limitation preventing transmitting two consecutive marks.

The flip flop 30 forms the word. The data word 40 will be observed not to include the clock pulses 32. Nevertheless, a change of polarity occurs so often in the word 40 at intervals timed by the clock operation that the clock pulses can be extracted from the data word 40. In other words, when a procession of several data words is transmitted, the receiving equipment can reconstruct the clock frequency with the changes in polarity found in the multiple data words so transmitted.

The foregoing is directed to the modulation equipment of the present invention. Its operation is exemplified by the wave form shown in FIG. 2. As will be observed, certain arbitrary constraints have been imposed on it such as the presumption that the octave designation number requires five bits and that each octave incorporates twelve keys. Needless to say, these can be varied as the need arises.

It will be observed that the positive and negative portions of the pulses are equal in duration. It is not essential that they be equal. If for instance, there is a substantial DC voltage offset as a result of an excessive number of ones or zeroes, the offset can be cancelled by adjusting the relative length of the pulses. Thus, the adjustment of the longer pulse lengths from the illustrated equal condition to a ratio of perhaps sixty percent to forty percent would be more than sufficient to typically overcome a large DC voltage offset as a result of a disproportionate mix in the ones and zeroes comprising the data.

It will be observed that the three signals have a relative ratio of one: three: four. This is the most efficient ratio. While other ratios could be selected, this ratio yields data which is easily detected and sorted on receipt, and moreover, shortens the word duration.

The present invention is disclosed in the context of a music encoding system. This was disclosed in applicant's copending patent application. The conductors from the output 30 can then be connected to any suitable communication equipment. Examples include frequency, phase, or amplitude modulation equipment. In addition, quadraphase or subsidiary communication authorization (SCA) equipment is quite readily adaptable to this data modulation apparatus. In any event, the present invention contemplates application with them in the event that such a modulation equipment is desired for transmission under a variety of circumstances.

An alternate encoding of the signals for sync, mark and space is possible. The preferred embodiment utilizes an arrangement where the signals have lengths of four, three and one time units with the sync and mark signals having one polarity (true or false) for the first two time units and then switching. The alternate form represents the sync, mark and space with signals which are respectively two units long, two units and then one unit. Their wave forms are as follows:

The sync is represented by true and true signals (two time units). The mark is represented by a true and false signal (two time units). The space is represented by a false signal of one time unit in length. Alternately, all three of these can be inverted so that the three respectively are false and false; false and then true; and true. It will be observed that the sync and mark arrangement in the two:two:one arrangement is identified by two units and a beginning polarity which is opposite that of the space signal.

The present invention has been described and exemplified by the foregoing, but the scope thereof is determined by the claims which follow.

I claim:

1. Apparatus for use with a data source which provides digital signals indicative of closure of keys on a keyboard instrument for transmission to another location, the modulating equipment comprising:

(a) input means for presenting digital data representative of the keys of a keyboard instrument which keys are subject to being played and wherein said keys are input in at least two groups of selected keys such that all keys are in designated groups;

(b) multiplexer means for scanning the digital data input means representative of the condition of the keys of the keyboard instrument which scanning occurs in a predetermined sequence and pattern, which pattern is defined by said input means in at least two groupings of size less than the sum of the keys of the keyboard so that the key condition is identified by a signal of the group and keys in the group;

(c) output means forming a binary signal;

(d) generator means connected to said multiplexer means, said generator means being operated by signals from said multiplexer means to form output signals for driving said output means which signals are characterized by the formation at said output means of a procession of binary pulses formed of logical zeroes and ones which define an output word therefrom wherein the output word encodes the logical ones and zeroes and the word includes a signal uniquely identifying a particular group of keys and the play condition of keys in that group; and (e) wherein said generator means includes a generator forming an output pulse for driving said output means and a second generator functioning similar to the first, said output wave forms differing by a ratio of one time unit to three time units where the three time units are divided, one unit to one polarity and two units to the opposite polarity.

2. The apparatus of claim 1 wherein said output means comprises a flip flop having two output conditions which are logical ones and zeroes.

3. The apparatus of claim 1 wherein said generator means comprises first, second and third generators forming binary signals having a relative duration of one, three and four time units each.

4. The apparatus of claim 3 wherein said second and third generators form signals which change binary values after two time units.

5. The apparatus of claim 4 wherein said output means forms a serial word made of binary signals which change binary values at least as often as every two time units, and once every time unit for the one time unit signal from said first generator.

6. The apparatus of claim 5 including a clock means forming an output every time unit which is input to said first, second and third generators.

7. The apparatus of claim 6 including a flip flop comprising said output means.

* * * * *